US007202427B2

(12) United States Patent
Bach et al.

(10) Patent No.: US 7,202,427 B2
(45) Date of Patent: Apr. 10, 2007

(54) SWITCH CONTACT ARRANGEMENT COMPRISING A DEVICE FOR INCREASING A CONTACT-FORCE ACTING BETWEEN SWITCH CONTACTS

(75) Inventors: Michael Bach, Berlin (DE); Michael Hahn, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 274 days.

(21) Appl. No.: 10/488,784

(22) PCT Filed: Sep. 3, 2002

(86) PCT No.: PCT/DE02/03327

§ 371 (c)(1),
(2), (4) Date: Mar. 5, 2004

(87) PCT Pub. No.: WO03/023800

PCT Pub. Date: Mar. 20, 2003

(65) Prior Publication Data

US 2004/0239459 A1 Dec. 2, 2004

(30) Foreign Application Priority Data

Sep. 6, 2001 (DE) ..... 101 44 440

(51) Int. Cl.
*H01H 1/50* (2006.01)
*H01H 75/00* (2006.01)

(52) U.S. Cl. ..... 200/250; 200/251; 335/46; 335/192

(58) Field of Classification Search ..... 335/6, 335/16, 46, 192; 200/250, 251, 255, 256
See application file for complete search history.

(56) References Cited

U.S. PATENT DOCUMENTS

| | | | | |
|---|---|---|---|---|
| 2,777,921 A | | 1/1957 | Latour | |
| 3,459,914 A | * | 8/1969 | Gustavson | 200/244 |
| 4,636,762 A | | 1/1987 | Marquardt | |
| 4,931,602 A | * | 6/1990 | Toda et al. | 218/153 |
| 6,018,284 A | * | 1/2000 | Rival et al. | 335/16 |

FOREIGN PATENT DOCUMENTS

| | | |
|---|---|---|
| DE | 478 488 | 6/1929 |
| DE | 588 293 | 11/1933 |
| DE | 101 44 440 C1 | 8/2002 |
| GB | 206 522 | 12/1924 |
| GB | 1 203 974 | 9/1970 |

* cited by examiner

*Primary Examiner*—Ramon M. Barrera
(74) *Attorney, Agent, or Firm*—Harness, Dickey & Pierce, P.L.C.

(57) ABSTRACT

A switch contact arrangement for a power switch is provided with a device for increasing the contact force acting between switch contacts. The device includes a cavity which is made in a stationary conductive element of the switch contact arrangement in such a manner that the direction of the current in the conductive element adjacent to the stationary switch contact runs essentially perpendicular to the longitudinal direction of the conductive element and therefore essentially parallel to the direction of current in an associated displaceable conductive element. The above-mentioned arrangement is suitable for low-voltage power switches with a selective form, whereby the switch contacts thereof allow a short-circuit current to be guided without premature opening.

13 Claims, 1 Drawing Sheet

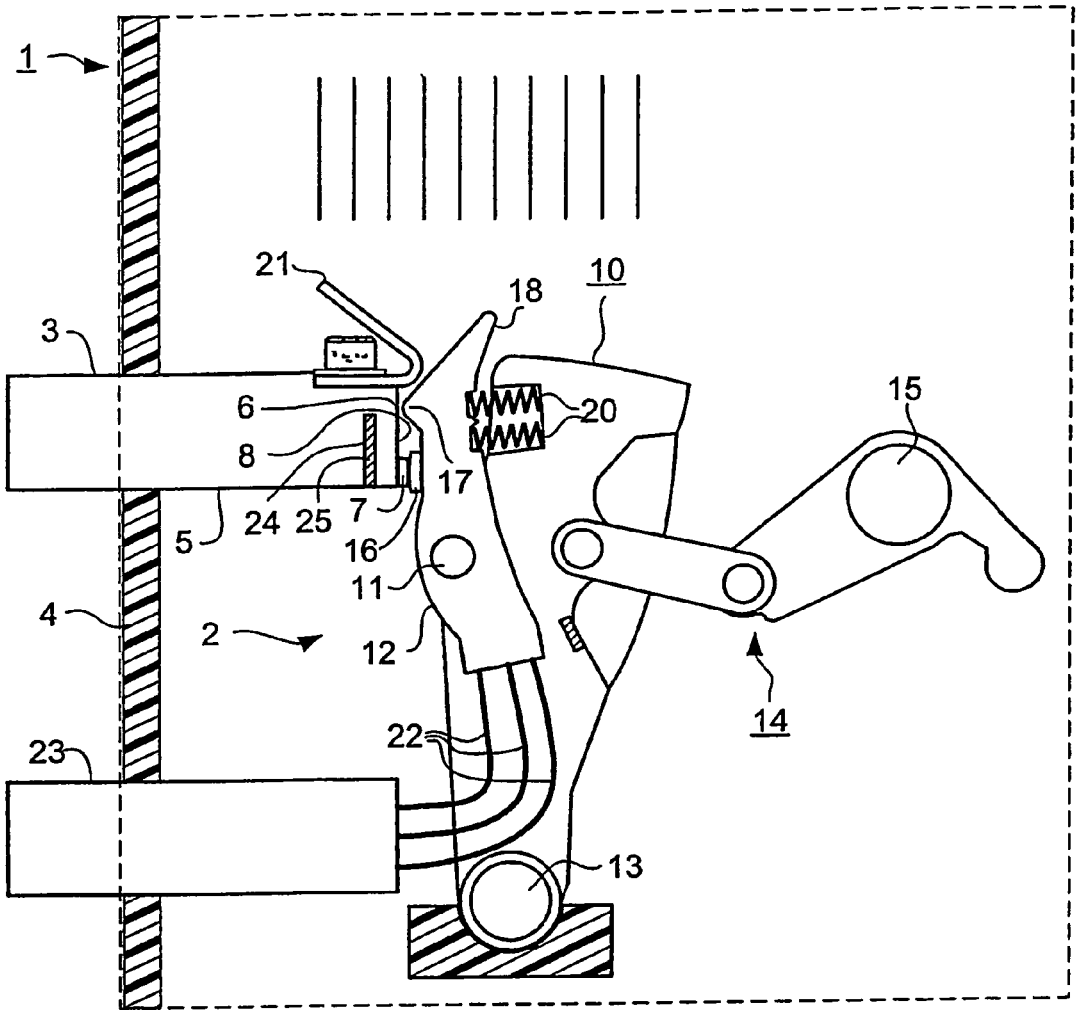
FIG 1
FIG 2
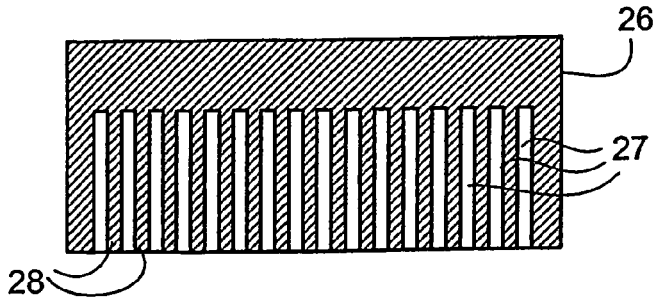
FIG 3
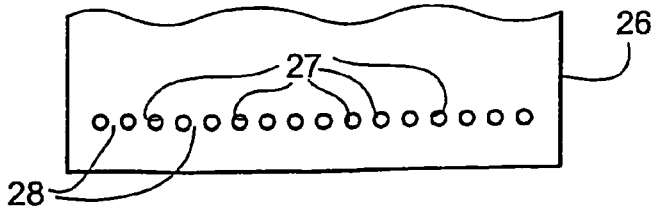

SWITCH CONTACT ARRANGEMENT COMPRISING A DEVICE FOR INCREASING A CONTACT-FORCE ACTING BETWEEN SWITCH CONTACTS

This application is the national phase under 35 U.S.C. § 371 of PCT International Application No. PCT/DE02/03327 which has an International filing date of Sep. 3, 2002, which designated the United States of America and which claims priority on German Patent Application number DE 101 44 440.0 filed Sep. 6, 2001, the entire contents of which are hereby incorporated herein by reference.

FIELD OF THE INVENTION

The invention generally relates to a switching contact arrangement for a circuit breaker. More preferably, it relates to a switching contact arrangement for a circuit breaker including a stationary conductor piece and a stationary switching contact fitted thereto, and including a moveable conductor piece and a moveable switching contact fitted thereto, intended to rest flat against the stationary switching contact, with the stationary and the moveable conductor pieces being approximately at right angles to one another when the switching contacts are closed. It furthermore includes a device for increasing the contact force acting between the switching contacts, by way of a recess which is incorporated in one of the conductor pieces transversely with respect to the direction of the current.

BACKGROUND OF THE INVENTION

A switching contact arrangement has been disclosed in U.S. Pat. No. 2,777,921. In the case of the device which has been mentioned, the contact force which acts between the switching contacts is increased in particular by compensating as far as possible for forces in opposite directions, that is to say forces which disconnect the switching contacts from one another. These disturbance forces are dependent on the magnitude of the current flowing via the switching contacts.

In the case of switching contacts which abut against one another, such as those which are used in particular in low-voltage circuit breakers, these contact-lifting forces always occur because they are physically unavoidable high current density forces. However, undesirable opening of the switching contacts is not permissible in the case of selective circuit breakers, that is to say those which have to carry a short-circuit current for a specific time without disconnection of the switching contacts.

U.S. Pat. No. 2,777,921 includes incisions are arranged in the conductor pieces to which the switching contacts are fitted, such that mutually parallel current paths are formed which exert an attractive effect on one another. These counteract the lifting high current density forces and entirely or partially compensate for them. Although these incisions obviously represent an effective means for overcoming the described problem, they lead to an increase in the size of the switching contact arrangement and can adversely affect its mechanical robustness.

It is also known for the contact force in a switching contact system to be increased by way of a current-dependent force which occurs in any case (U.S. Pat. No. 4,636,762). For this purpose, a flexible conductor, which is required in any case in order to connect the moveable switching contact to a stationary connecting piece, is supported on a loop which is connected to the moveable switching contact. It is supported in such a way that a torque which acts in the closing direction is transmitted to the moveable switching contact, which is arranged on a contact mount such that it can pivot.

However, this highly effective arrangement requires additional parts, which significantly increase the moving mass of the moveable part of the switching contact arrangement. They thus necessitate greater opening forces for the switching processes.

SUMMARY OF THE INVENTION

An embodiment of the invention includes a switching contact arrangement in which the current is deflected by way of a recess, in consequence producing an attraction force, which is dependent on the current, between the interacting switching contacts. It includes an object of simplifying the arrangement of the recess in such a way that it can be produced using simple means, and such that any design changes to the switching contact arrangement in order to accommodate the recess are as minor as possible.

According to an embodiment of the invention, an object may be achieved by the recess being incorporated in the stationary conductor piece such that the direction of the current in a part of the stationary conductor piece which is immediately adjacent to the stationary switching contact is aligned approximately parallel to the direction of the current in the moveable conductor piece. It is has been found that this simple configuration of the switching contact arrangement, which is associated with low costs, leads to a considerable reduction in the current-dependent, contact-lifting forces. One feature in this case is that no changes need be made to the normal configuration of the entire moveable part of the switching contact arrangement.

For the purposes of an embodiment of the invention, it is possible to provide that the stationary switching contact is arranged on an area element of an end face of the stationary conductor piece facing the moveable switching contact, and a further area element forms a stationary initial contact piece. The recess is arranged close to the stationary switching contact and approximately parallel to the end face and, starting from an edge surface of the conductor piece, extending parallel to the initial contact piece into the stationary conductor piece.

This configuration means that the current which flows through the stationary conductor piece in its longitudinal direction in normal switching contact arrangements is deflected at right angles to the longitudinal direction of the conductor piece close to its end face to which the stationary switching contact is fitted. A portion of the current path in the stationary conductor piece thus extends approximately parallel to the current path in the moveable conductor piece, and this results in an attractive force. There is no need to increase the thickness or the height of the stationary conductor piece in comparison to a previously normal embodiment in order to achieve this effect. In fact, the stationary conductor piece can be used with normal dimensions.

It is has been found to be expedient to form the recess by an incision with parallel ends. This incision can be filled with an electrically non-conductive or slightly conductive filling (filling piece or filling material) in order to maintain the resistance of the stationary contact piece as far as possible with respect to the forces that occur during switching.

A further suitable possible way to form the recess is to incorporate closely adjacent parallel holes in the conductor piece. Owing to the local reduction in the conductor cross section, the holes have a similar effect to the continuous recess in diverting the current parallel to the end surface of the conductor piece. However, the webs which remain between the holes ensure better mechanical robustness. However, in conjunction with these holes, strength which corresponds approximately to that of a solid conductor piece can also be achieved by filling the holes with a filling of the type mentioned.

BRIEF DESCRIPTION OF THE DRAWINGS

Further advantages, features and details of the invention will become evident from the description of illustrated embodiments given hereinbelow and the accompanying drawings, which are given by way of illustration only and thus are not limitative of the present invention, wherein:

FIG. 1 shows a cross section through a main current path of a low-voltage circuit breaker 1, which is only indicated.

FIG. 2 shows a section through a stationary conductor piece of a main current path and of a switching contact arrangement, in which a recess is in the form of a large number of holes.

FIG. 3 shows the conductor piece shown in FIG. 2, cutaway from underneath.

DETAILED DESCRIPTION OF THE PREFERRED EMBODIMENTS

The circuit breaker 1 shown in FIG. 1 has a main current path with a switching contact arrangement 2 in which main and initial contacts as well as arcing horns are provided in a known manner. The switching contact arrangement 2 has an upper stationary conductor piece 3, which is in the form of a connecting rail for the circuit breaker 1, and for this purpose is supported in an opening in a rear wall 4 of the circuit breaker 1. The conductor piece 3 may have an essentially rectangular cross-sectional shape in a known manner, which includes a lower edge surface 5 and an inner end face 6. A stationary switching contact 7 is fitted to an area element of the end face 6 and is produced, in a known manner, as a switching piece coating composed of a specific contact material. The remaining, larger area element of the end face 6 forms a stationary initial contact piece 8.

The moving part of the switching contact arrangement 2 is formed by an assembly that is composed of two or more components and which includes, in particular, a contact mount 10 and a conductor piece 12 which can move on it about a pivoting bearing 11. At its lower end, the contact mount 10 is mounted using a pivoting journal 13 such that it can pivot, and can be moved in a known manner by a switching shaft 15, by use of a lever arrangement 14, for switching the switching contact arrangement 1 on and off. The moveable conductor piece 12 is in the known form of a contact lever which, at its upper end, is provided with a moveable switching contact 16, a moveable initial contact 17 and an arcing horn 18. Contact force springs 20 ensure that there is a reasonable contact force between the interacting switching contacts 7 and 16 when the switching contact arrangement 2 is in the closed state. Opposite the moveable arcing horn 18 there is an arcing horn 21 which is attached to the upper edge surface of the conductor piece 3.

Flexible conductors 22 are fitted to an end part of the conductor piece 12 projecting beyond the pivoting bearing 11, in order to connect the conductor piece to a lower stationary conductor piece 23. The conductor piece 23 is likewise supported on the rear wall 4, and extends parallel to the upper stationary conductor piece 3.

Depending on the intended load capacity, the switching contact arrangement 2 may have two or more conductor pieces 12, arranged parallel to one another in a common contact mount 10. These interact with conductor pieces 3 and 23, which are likewise common.

when the switching contact arrangement 2 is in the switched-on position as illustrated, a current flows through the upper stationary conductor piece 3, the switching contacts 7 and 16 which are subject to the influence of the contact force springs 20, the conductor piece 12 or the parallel conductor pieces 12, as well as the flexible conductors 22 and the lower conductor piece 23. In the process, the high current density forces which were mentioned initially occur between the switching contacts 7 and 16 and counteract the contact force which is applied by way of the contact force springs 20. A recess 24 which is arranged in the stationary conductor piece 3 ensures that the contact-lifting forces which have been mentioned are at least partially compensated for. For this purpose, the recess 24 is arranged close to the end face 6 of the conductor piece 3, and parallel to the end face 6. In this case, it is expedient for the recess 24 to extend over the entire width of the connector piece 3.

As can be seen, the recess 24 starts from the lower edge surface 5 and runs parallel to the end face 6 and to the stationary initial contact piece 8 which is formed by it. This recess 24 has the effect that a current entering or leaving the stationary switching contact 7 cannot flow through the conductor piece 3 in a straight line in its longitudinal direction, but is caused to be deflected by the recess 24, leading to a current direction running parallel to the end face 6, close to the end face 5. Thus, in this part of the conductor piece 3, the current runs approximately parallel to the current in the moveable conductor piece 12 (contact lever), and this results in an attractive effect. This entirely or partially compensates for the contact-lifting high current density forces.

A filling material 25, which is indicated in the figure, may be in the form of a strip of insulating material which is matched to the width of the recess 24. In the same way, the recess 24 may be filled with a curing synthetic resin compound, to which mineral components are added. It is not necessary for the effectiveness of the recess 24 for the filling material or the filling piece to be completely non-conductive. The desired deflection of the current can be achieved even by a metal whose electrical conductance is considerably less than that of the conductor piece 3, even if this is not in a complete form, as in the case of a filling that is non-conductive.

The same applies to the situation in which, as is shown in FIGS. 2 and 3, a stationary conductor piece 26 is used whose recess is formed by a large number of adjacent holes 27 between which narrow webs 28 are provided, and which start from a lower edge surface 29. The webs 28 between the recesses 27 (holes) act like an increased resistance, and likewise result in the deflection of the current as explained.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A switching contact arrangement for a circuit breaker, comprising:

a stationary conductor piece;

a stationary switching contact, fitted to the stationary conductor piece;

a moveable conductor piece;

a moveable switching contact, fitted to the moveable conductor piece and intended to rest flat against the stationary switching contact, wherein the stationary and the moveable conductor pieces are approximately at right angles to one another when the switching contacts are closed;

at least one recess, incorporated in the stationary conductor piece such that a direction of the current, in a part of the stationary conductor piece immediately adjacent to the stationary switching contact, is aligned approximately parallel to the direction of the current in the moveable conductor piece.

2. The switching contact arrangement as claimed in claim 1, wherein the stationary switching contact is arranged on an area element of an end face of the stationary conductor piece facing the moveable switching contact, and a further area element forms a stationary initial contact piece, wherein the recess is arranged close to the stationary switching contact and approximately parallel to the end face and, starting from an edge surface of the conductor piece, extending parallel to the initial contact piece into the stationary conductor piece.

3. The switching contact arrangement as claimed in claim 1, wherein the recess is formed by an incision with parallel walls.

4. The switching contact arrangement as claimed in claim 1, wherein the recess is formed by closely adjacent parallel holes.

5. The switching contact arrangement as claimed in claim 3, wherein the recess contains at least one of an electrically non-conductive and slightly conductive filling.

6. The switching contact arrangement as claimed in claim 1, wherein the recess is for increasing contact force acting between the switching contacts.

7. The switching contact arrangement as claimed in claim 1, wherein the stationary switching contact is arranged on an area element of an end face of the stationary conductor piece facing the moveable switching contact, and a further area element forms a stationary initial contact piece, wherein the recess is arranged close to the stationary switching contact and approximately parallel to the end face.

8. The switching contact arrangement as claimed in claim 2, wherein the recess is formed by an incision with parallel walls.

9. The switching contact arrangement as claimed in claim 6, wherein the recess is formed by an incision with parallel walls.

10. The switching contact arrangement as claimed in claim 7, wherein the recess is formed by an incision with parallel walls.

11. The switching contact arrangement as claimed in claim 2, wherein the recess is formed by closely adjacent parallel holes.

12. The switching contact arrangement as claimed in claim 4, wherein the recess contains at least one of an electrically non-conductive and slightly conductive filling.

13. A switching contact arrangement for a circuit breaker, comprising:

a stationary conductor piece;

a stationary switching contact, fitted to the stationary conductor piece;

a moveable conductor piece;

a moveable switching contact, fitted to the moveable conductor piece, wherein the stationary and the moveable conductor pieces are approximately at right angles to one another when the switching contacts are closed;

means for increasing contact force acting between the switching contacts, incorporated in the stationary conductor piece such that a direction of the current, in a part of the stationary conductor piece immediately adjacent to the stationary switching contact, is aligned approximately parallel to the direction of the current in the moveable conductor piece.

* * * * *